US009421434B2

(12) United States Patent
Takagi et al.

(10) Patent No.: US 9,421,434 B2
(45) Date of Patent: Aug. 23, 2016

(54) GOLF CLUB HEAD

(71) Applicant: Bridgestone Sports Co., Ltd., Tokyo (JP)

(72) Inventors: Masaya Takagi, Tokyo (JP); Takaharu Takechi, Tokyo (JP); Tomonori Kitagawa, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/853,257

(22) Filed: Sep. 14, 2015

(65) Prior Publication Data

US 2016/0158609 A1 Jun. 9, 2016

(30) Foreign Application Priority Data

Dec. 8, 2014 (JP) ..... 2014-248042

(51) Int. Cl.
*A63G 11/00* (2006.01)
*A63B 53/04* (2015.01)

(52) U.S. Cl.
CPC .... *A63B 53/0466* (2013.01); *A63B 2053/0408* (2013.01)

(58) Field of Classification Search
CPC ..... A63B 53/0466
See application file for complete search history.

(56) References Cited

U.S. PATENT DOCUMENTS

| | | | | |
|---|---|---|---|---|
| 4,754,974 | A * | 7/1988 | Kobayashi | A63B 53/04 473/327 |
| 7,494,425 | B2 * | 2/2009 | De Shiell | A63B 53/0466 473/345 |
| 7,582,024 | B2 | 9/2009 | Shear | |
| 2003/0125127 | A1 * | 7/2003 | Nakahara | A63B 53/04 473/329 |
| 2011/0218053 | A1 * | 9/2011 | Tang | A63B 53/04 473/349 |
| 2013/0178305 | A1 * | 7/2013 | Beno | A63B 53/06 473/287 |
| 2014/0087893 | A1 * | 3/2014 | Henrikson | A63B 53/0466 473/327 |

FOREIGN PATENT DOCUMENTS

| | | | |
|---|---|---|---|
| JP | H10-263118 | A | 10/1998 |
| JP | 2001-070484 | A | 3/2001 |
| JP | 2003-210621 | A | 7/2003 |
| JP | 2013-165962 | A | 8/2013 |

* cited by examiner

*Primary Examiner* — Michael Dennis
(74) *Attorney, Agent, or Firm* — Muncy, Geissler, Olds & Lowe, P.C.

(57) ABSTRACT

A golf club head having a face part, a sole part, a side part, a crown part and a hosel part, all of which surround a hollow part comprises a penetration hole that is provided on the crown part, penetrating the crown part so that the hollow part is connected with an outer atmosphere of the golf club head and a non-metal cover that is provided over the penetration hole. A recess part, which forms a recess, is provided on a surface of the non-metal cover.

14 Claims, 5 Drawing Sheets

GOLF CLUB HEAD

CROSS REFERENCE

The present application is related to, claims priority from and incorporates by reference Japanese Patent Application No. 2014-248042, filed on Dec. 8, 2014.

TECHNICAL FIELD

The invention relates to a hollow golf club head, more specifically to a hollow golf club head of which a portion of the crown part is made of a non-metal material.

BACKGROUND

A hollow metallic head has been widely used as a wood type golf club head such as a driver and a fairway wood. In general, a hollow wood type golf club head includes a face part, a crown part, a sole part, a side part and a hosel part. The face part is for hitting a ball. The crown part comprises an upper surface of the golf club head. The sole part comprises a bottom surface of the golf club head. The side part comprises lateral surfaces of the head at the toe and back and heel sides. A shaft is inserted to the hosel part, fixed with adhesive. Recently, a number of new golf clubs, called utility clubs, have been sold on the market. Various types of golf clubs having hollow heads (namely, heads having face part, sole part, side part, crown part and hosel part), which resemble the above wood type golf club head, also are sold as one type of these utility golf clubs.

For the metals configuring the hollow golf club heads, aluminum alloys, stainless and titanium alloys are used. Recently, the titanium alloys are widely used.

Patent Document 1 describes that a launch angle is enlarged as well as resilience is improved by providing a slit on a crown part of a hollow golf club head. Patent Document 1 further describes that the slit is covered/filled with a reinforce material that is made of material whose elasticity is lower than that of a metal.

Patent Document 2 describes that, in order to decrease a metal sound at hitting with a hollow golf club head, a penetration hole with 5 mm to 15 mm diameter is provided on its crown and a sound deadening material made of polyester elastomer, thermoplastics resin, or rubber is fit/fixed in the penetration hole.

Patent Document 3 describes that, in a golf club head in a shell structure, a penetration groove or penetration hole having more than 20 mm length in a longitudinal direction of a topline is provided on a crown part and the penetration groove or penetration hole is filled with a material having Young modules smaller than other portions.

Patent Document 4 describes that a stress reducing structure is provided on a crown part and sole part of a golf club head having a hollow part.

Patent Document 5 describes a structure in which an opening is provided on a top part of body of a hollow golf club head and the opening is closed with a fiber content hybrid material such as carbon filling nylon.

Patent Document 6 describes that a slot is provided on a crown part and an elastomer filling material is provided in the slot.

PRIOR ART DOCUMENTS

Patent Doc. 1: JP2003-210621
Patent Doc. 2: JP2001-070484

Patent Doc. 3: JPH10-263118
Patent Doc. 4: JP2013-165962
Patent Doc. 5: U.S. Pat. No. 7,494,425
Patent Doc. 6: U.S. Pat. No. 7,582,024

The invention aims to provide a golf club head with which an initial velocity of a hit golf ball becomes larger and a launch angle thereof also becomes higher.

SUMMARY

A golf club head, which is disclosed in the application, having a face part, a sole part, a side part, a crown part and a hosel part, all of which surround a hollow part comprises a penetration hole that is provided on the crown part, penetrating the crown part so that the hollow part is connected with an outer atmosphere of the golf club head and a non-metal cover that is provided over the penetration hole. A recess part, which forms a recess, is provided on a surface of the non-metal cover.

It is preferred that a material of the non-metal cover is resin. The recess part preferably extends in a toe-heel direction of the head. Also, there may be two or more recess parts on the head.

With the golf club head of the invention, because of the penetration hole provided on the crown part, the crown part easily deflects at impact.

In the golf club head of the invention, the non-metal cover is provided over the penetration hole. Since a recess part is provided on the non-metal cover, it is achieved that a force, which works to recover the deflected golf club head at hitting a golf ball into an original shape, is given, also a vibration of the head is absorbed and the hitting feeling is improved, making it possible to adjust a deflection amount of the head when the head hitting a ball.

With the structure, when using the golf club head equipped with the golf club head of the invention, the initial velocity of a golf ball is large, the launch angle is high. By these effects being accumulated, the carry distance increases.

DETAILED DESCRIPTION OF PREFERRED EMBODIMENTS

Referring to FIGS. 1 to 5, a golf club head according to one embodiment is explained.

Figure 1:
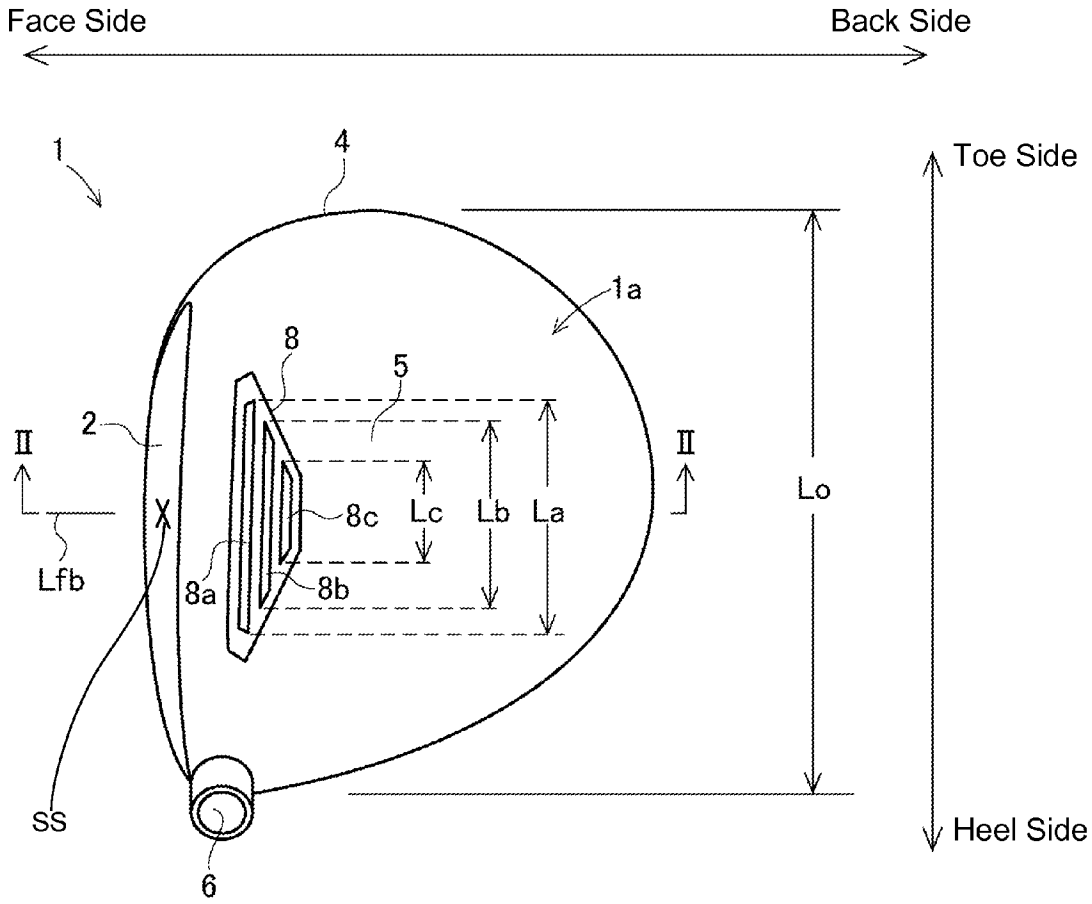
FIG. 1 illustrates a plan view of a golf club head according to one embodiment.
Figure 2:
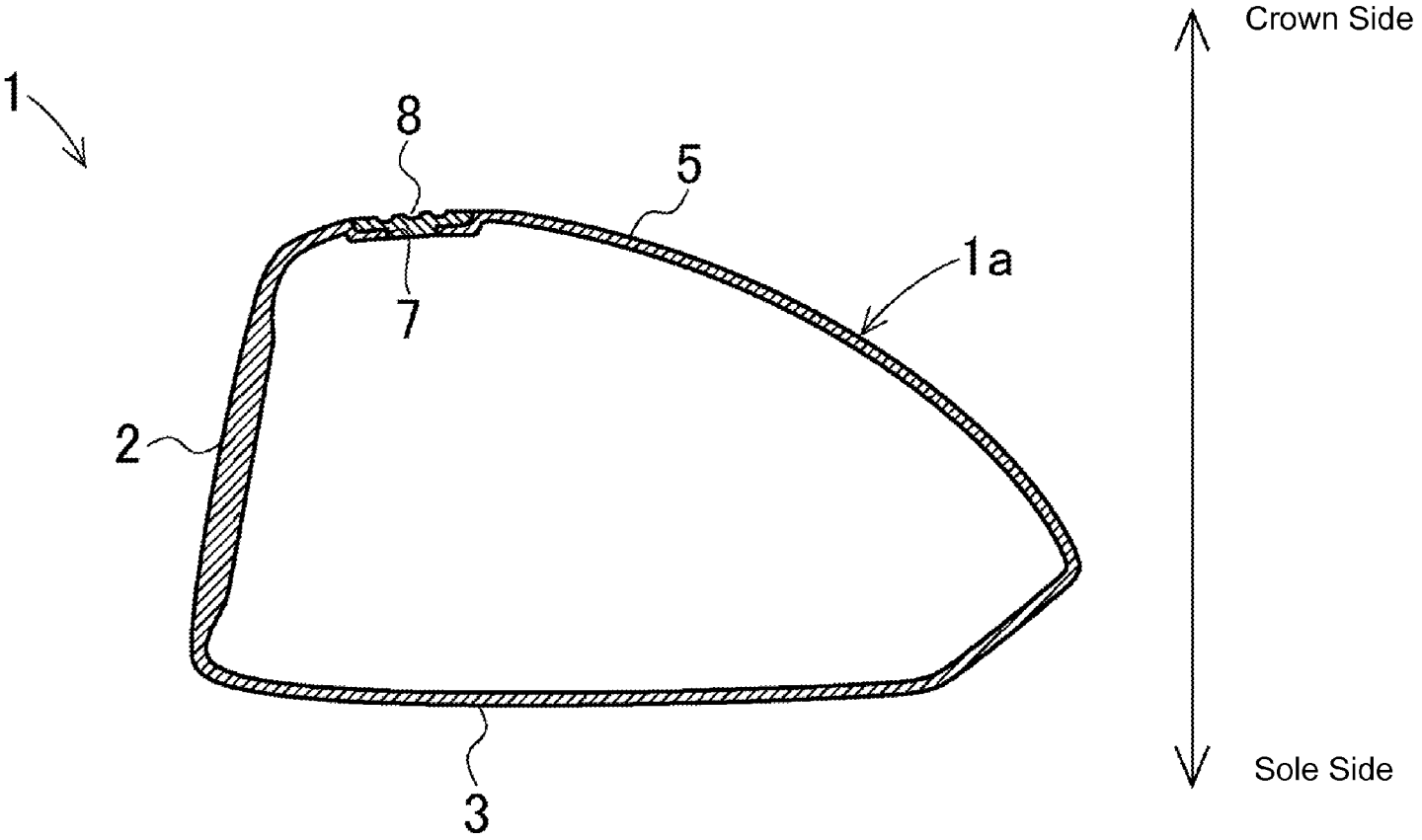
FIG. 2 illustrates a sectional view cut along II-II line in FIG. 1.

As shown in FIGS. 1 and 2, the golf club head 1 is a hollow driver head of which a head body 1*a* includes a face part 2, a sole part 3, a side part 4, a crown part 5 and a hosel part 6.

The face part 2 is a surface for hitting a ball. The sole part 3 comprises a bottom surface of the golf club head. The side part 4 comprises lateral surfaces at the toe side,-heel side and back side (rear surface side). The crown part 5 comprises an upper surface of the golf club head. A shaft is inserted to the hosel part 6, being fixed thereto with adhesive.

In the vicinity of a front edge P (see FIG. 3) of the crown part 5 of the golf club head 1, a penetration hole 7, which extends in the toe-heel direction, is provided. The penetration hole 7 is closed with a non-metal cover 8. An imaginary straight line passing through a center of the penetration hole 7 in the face to back side is denoted with Lfb in FIG. 1. The center of the penetration hole 7 is defined in the toe-heel direction in the plan view shown in FIG. 1. In the plan view, the golf club 1 is viewed from the perpendicular top with respect to a horizontal plane where the sole part 3 of the golf club head 1 is placed on the horizontal plane with the regulated lie angle and real loft angle. In the embodiment, the straight line Lfb is arranged to be at a sweet spot (SS) of the face part 2. It may be practical to arrange the straight line Lfb in the vicinity of the sweet spot or a half way line of the head 1. The half way line is defined as a line equally dividing the head in the toe-heel direction in the plan view as seen in FIG. 1.

Figure 3:
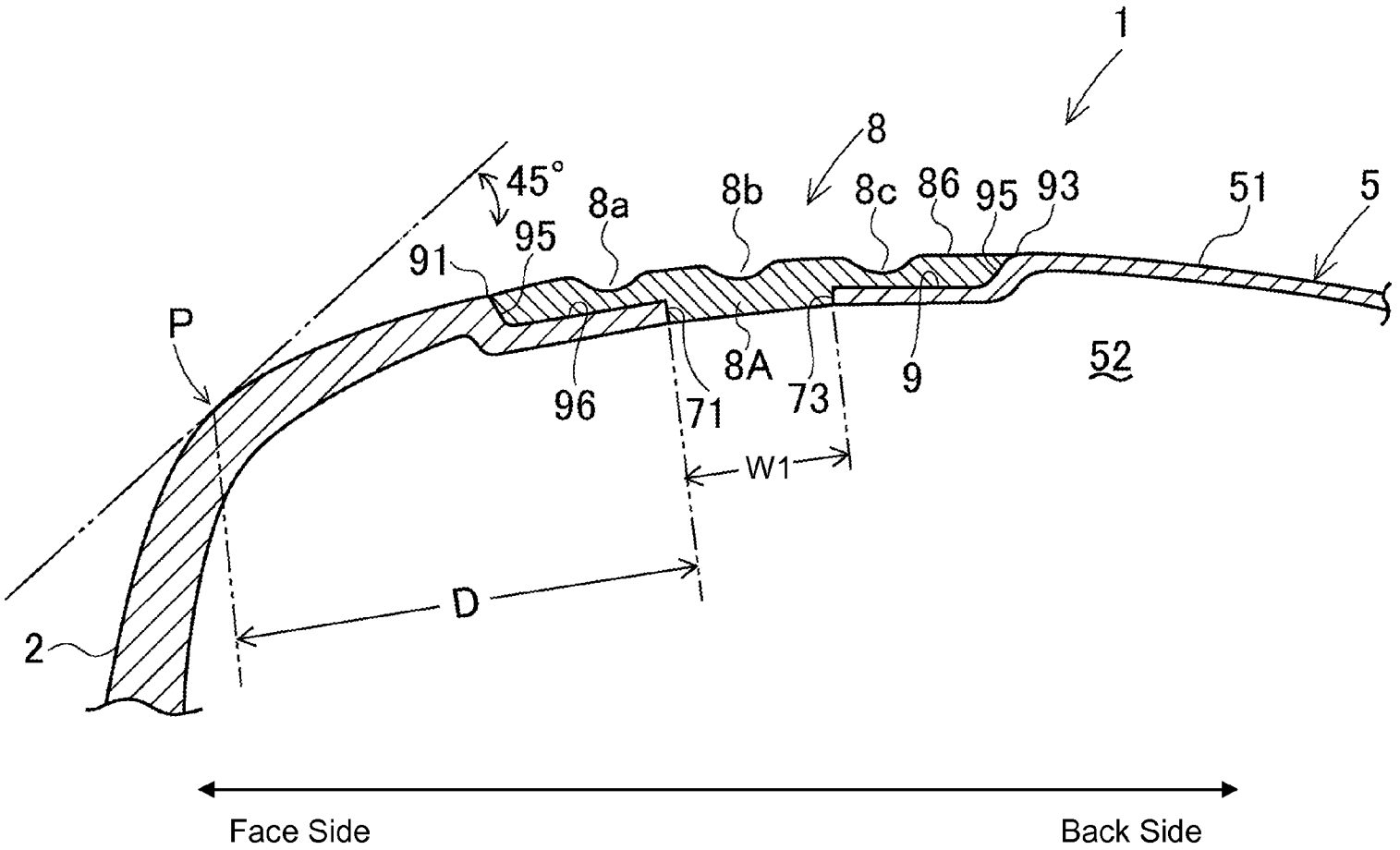
FIG. 3 illustrates an enlarged view of a portion in FIG. 2.

In the embodiment, as shown in FIG. 3, a step part 9 is provided at the crown part 5 in a fashion surrounding the penetration hole 7, being recessed toward a hollow part side 52 rather than a crown outer surface 51. The non-metal cover 8 is attached to the step part 9. Numeral 95 means a step side surface that is a surface downwardly connecting to the surrounding crown outer surface 51. The boundary portions between the step side surface 95 and the crown outer surface 51 are denoted with step outer edges 91, 92 (92*a*, 92*b*), 93, 94 (94*a*, 94*b*). The non-metal cover 8 is placed on a bottom surface 96 of the step part 9.

Figure 5:
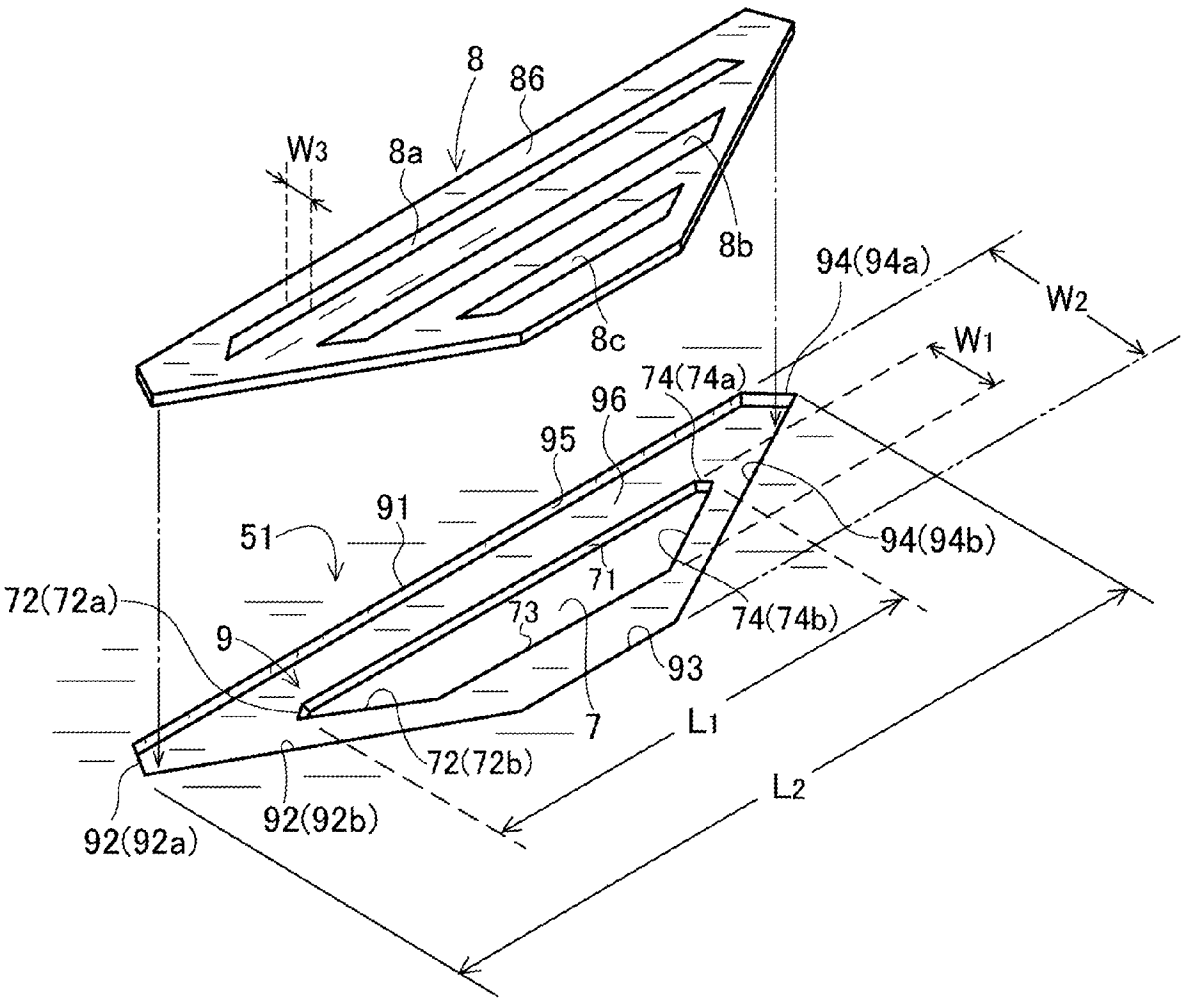
FIG. 5 illustrates an exploded perspective view of the vicinity of a penetration hole on a crown part of the golf club head according to the embodiment.

As shown in FIG. 5, the penetration hole 7 is an approximate trapezoid shape in the above plan view. A side edge 71 at the face side and a side edge 73 at the back side are substantially parallel, each of which extends in the toe-heel direction. Among side edge 72 (72*a*, 72*b*) at the heel side and side edge 74 (74*a*, 74*b*) at the toe side of the penetration hole 7, the two of the side edges 72*a* and 74*a* at the face side extend in inclined directions with respect to the toe-heel direction, approaching each other as getting close to the face side. Contrarily, the two of the side edges 72*b* and 74*b* at the back side extend in inclined directions with respect to the toe-heel direction, approaching each other as getting close to the back side.

The step part 9 as well is approximate trapezoid shape in the plan view. A step outer edge 91 at the face side and a step outer edge 93 at the back side are substantially parallel, each of which extends in the toe-heel direction. Among step outer edge 92 (92*a*, 92*b*) at the heel side and step outer edge 94 (94*a*, 94*b*) at the toe side of the step part 9, the side outer edges 92*a* and 94*a* both at the face side extend in inclined directions with respect to the toe-heel direction, approaching each other as getting close to the face side. Contrarily, the step outer edges 92*b* and 94*b* both at the back side extend in inclined directions with respect to the toe-heel direction, approaching each other as getting close to the back side.

Figure 4:
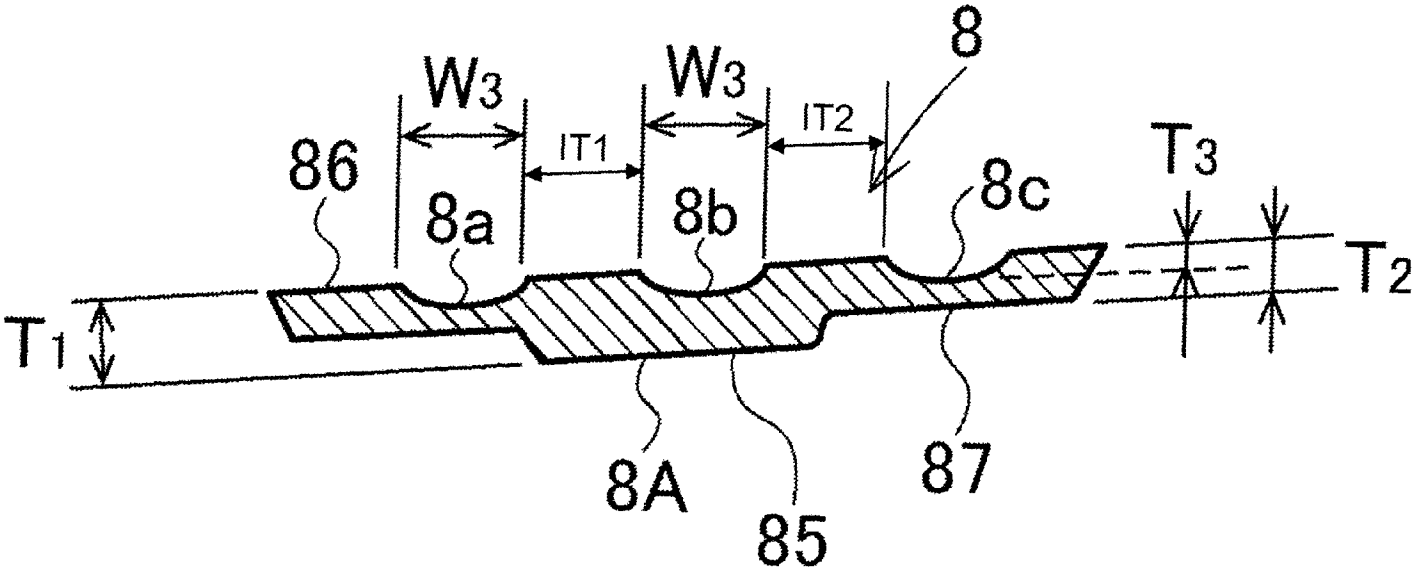
FIG. 4 illustrates a sectional view of a non-metal cover.

The non-metal cover 8 has an identical outer shape to the step outer edges 91-94 in the plan view in order to mate with the step part 9. As shown in FIG. 4, the non-metal cover 8 has a projection part 8A that projects from a lower surface 87, having an identical shape to the penetration hole 7 in order to mate with the penetration hole 7.

On an upper surface 86 of the non-metal cover 8, a plurality of recess parts 8*a*, 8*b*, 8*c*, which extend in the toe-heel direction and are in a grove shape, are provided. In the embodiment, the number of the recess parts is three.

The non-metal cover 8 is attached to the bottom surface 96 of the step part 9 by inserting the projection part 8A into the penetration hole 7 and by adhering the lower surface 87 to the bottom surface 96 with a common adhesive means such as an adhesive agent (including a sticking agent), a double side adhesive tape, Velcro tape (trademark), or a screw. Where the adhesive means is one of the double side adhesive tape, Velcro tape (trademark) and the screw, it is possible to relatively easily attach and detach the non-metal cover to the head. Also it is preferred that one of the recess parts 8*a*, 8*b*, 8*c* is positioned on an opposite side from the projection part 8A. Shown in FIG. 3, the recess part 8*b*, which is the middle one of the three recesses, is located on the upper surface 86 of the non-metal cover 8, facing outwardly (upward in the figure). The projection part 8A is located, on the other hand, on the opposite surface of the cover 8 from the upper surface, facing the hollow part (or downward in the figure). Assuming that a width of the penetration hole 7 in the face-back direction is denoted with W1, the recess part 8*b* is positioned within the width W1 in the toe-heel view. Putting it another way, the recess part 8*b* is positioned above/within the penetration hole 7.

Except for the recess parts 8*a*, 8*b*, 8*c*, the upper surface of the non-metal cover 8 is flush with the crown outer surface 51 at the surrounding. The upper surface may be projecting or being recessed.

Regarding the materials of the non-metal cover 8, any material made of rubber or resin is to be listed. Regarding rubber, for example, natural rubber, polybutadiene rubber, styrene-butadiene rubber or isoprene rubber etc., are available. Regarding resin, for example, ionomeric resin, urethane resin, polyester resin, or polyamide resin etc., are available. Specifically, urethane resin is preferred. The Shore D hardness of the non-metal cover is preferred to be no less than 55, more preferably no less than 65 and no more than 80, more preferably no more than 75. By putting the Shore D hardness within that range, it is possible to more quickly recover a deflected golf club head at hitting a ball to be in an original shape.

A golf club head body 1*a* is made of metal in a single piece. Regarding the metal, titanium, titanium alloy, aluminum alloy, or stainless steel etc. is an example. The titanium alloy is preferred. Additionally, a portion of the golf club head 1 may be made of non-metal material such as fiber reinforced plastic etc. Also, an ornamental part or support plate/name plate which is made of synthetic resin, rubber, or elastomer etc. may be provided on a portion of the golf club head 1, for example, on the sole part or on the side part. Weight material made of tungsten or etc. may be provided on the golf club head 1.

Next, preferred ranges of size of the golf club head 1, specifically the penetration hole 7, the non-metal cover 8 and the step part 9 are to be explained.

When the golf club head 1 is a driver head, as shown in FIG. 1, the maximum size Lo of the head from the plan view in the toe-heel direction, which excludes the hosel part 6, is not strictly limited (or flexible), however, is preferably no less than 100 mm and no more than 150 mm (inclusive).

As shown in FIG. 3, the distance D, which is determined from the side edge 71 of the penetration hole 7 which is the closest to the face side, to the front edge P of the crown part 5 is preferably no less than 5 mm, more preferably no less than 10 mm, and no more than 35 mm, more preferably no more than 30 mm. The front edge P of the crown part 5 is determined as a continuous portion along the top-heel direction where a tangent line therefrom is angled by 45 degrees with respect to the horizontal plane, under a condition where the sole part 3 of the golf club head 1 is placed on the horizontal plane with the regulated lie angle and real loft angle. FIG. 3 shows a portion of the front edge P, which is formed at an intersection between the face part 2 and the crown part 5, in the vertical sectional view cut along line Lfb. Putting the distance D within the range, the crown part is to be more deflectable.

A length L1 of the penetration hole 7 in the toe-heel direction is preferably no less than 20 mm and no more than 100 mm. A width W1 of the penetration hole 7 in the face-back direction (front-rear direction) is preferably no less than 2 mm and no more than 30 mm.

A length L2 of the step part 9 in the toe-heel direction is preferably no less than 25 mm and no more than 110 mm. A width W2 of the step part 9 in the face-back direction is preferably no less than 4 mm and no more than 40 mm.

Widths of the recess parts 8*a*, 8*b*, 8*c*, which are provided on the non-metal cover 8, are preferably no less than 1 mm and no more than 10 mm. Regarding intervals (IT1, IT2) between these recess parts in the face-back direction, these intervals are substantially the same in FIG. 4, but may be different considering characteristics of the material, shapes or sizes of the recess parts.

Lengths La, Lb, Lc of the recess parts 8*a*-8*c* in the toe-heel direction are preferably no less than 15 mm and no more than 105 mm.

Thickness T1 of a portion corresponding to the projection part 8A is preferably no less than 0.5 mm and no more than 10 mm. Thickness T2 of the non-metal cover 8, which is determined from the upper surface 86 to the lower surface 87, is preferably no less than 0.25 mm and no more than 9.5 mm.

Depths T3 of the recess parts 8*a*, 8*b*, 8*c* are preferably no less than 0.1 mm and no more than 9 mm.

The sectional shapes of the recess parts 8*a*, 8*b*, 8*c* in the face-back direction are in arc shapes in this embodiment. U-letter shape, V-letter shape, rectangle shape or polygon shape, which has more than 5 corners, may be applied.

There is no limitation for the number of the recess parts. However, no less than 1 piece to no more than 10 pieces are practical.

With the golf club head 1 structured in the above matter, since the penetration hole 7 is provided on the crown part 5, the crown part 5 is easily deflected at hitting a golf ball. By proving the non-metal cover 8 having the recess parts 8*a*-8*c* on the penetration hole 7, it is possible to generate a recovering force by which the deflected golf club head at hitting a golf ball recovers to the original shape, to absorb vibrations of the head, to improve the hitting feeling and to adjust the deflection amount of the head at hitting a ball.

Therewith, when the golf club equipped with the golf club head 1 is used, the initial velocity of the hit ball becomes larger, the launch angle becomes higher, enlarging the carry distance.

In the embodiment above, the penetration hole 7 has the approximate trapezoid shape from the plan view. Other shape, such as a rectangle, oval, or triangle shape etc. elongated in the toe-heel direction, also are practical.

In the embodiment above, the recess parts 8*a*-8*c* are each provided as recess grooves continuously extending in the toe-heel direction. The grooves may break at least at a middle portion. Further, recess parts having various shapes, such as circle, oval, triangle, rectangle, or polygon etc. may be arranged into multiple lines in the toe-heel direction. These lines may be parallel or may not be parallel. In the embodiment shown in the figures, the recess parts 8*a* and 8*c* are not located above the penetration hole 7. The recess parts 8*a* and 8*c* may have penetrating portions therein. Or, these recess parts may be formed as a penetrating shape. Since the recess parts 8*a* and 8*b* are located out of the penetration hole, such a penetrating shape cannot reach the penetration hole 7 formed on the crown. Therefore, the non-metal cover having such a penetrating shape is able to close or completely cover the penetration hole.

The recess part may be placed on a lower surface 85 of the projection part 8A of the non-metal cover 8.

In the above embodiment, the penetration hole 7 and the non-metal cover 8 are provided only at the front edge P side of the crown part 5. The penetration hole may be provided on the side part 4, and the hole may be closed with a non-metal cover.

The above descriptions represent one example of the invention. The invention can be embodied with other structures other than the discussion above. The invention may be applied to any type of head of a fairway wood, a utility club other than a driver.

What is claimed is:

1. A golf club head having a face part, a sole part, a side part, a crown part and a hosel part, all of which surround a hollow part, comprising:

a penetration hole that is provided on the crown part, penetrating the crown part so that the hollow part is connected to an outer atmosphere of the golf club head; and a non-metal cover that is provided over the penetration hole, wherein three or more recess parts, each of which forms a recess, are provided on a surface of the non-metal cover, the recess part extends in a toe-heel direction of the head, these recess parts extending in the toe-heel direction are arranged in a face-back direction, which is perpendicular to the toe-heel direction, with an interval, one of the recess parts, which is not the closest to the face part or farthest from the face part in the face-back direction, is positioned above the penetration hole.

2. The golf club head according to claim 1, wherein the surface of the non-metal cover on which the recess part is provided is an upper surface of the non-metal cover.

3. The golf club head according to claim 2, wherein the recess part is located above the penetration hole.

4. The golf club head according to claim 1, wherein a material of the non-metal cover is resin.

5. The golf club head according to claim 1, wherein the penetration hole extends in the toe-heel direction.

6. The golf club head according to claim 1, wherein a step part, which is recessed toward the hollow part, is formed on the crown part, surrounding the penetration hole so that an upper surface of the step part is lowered than an upper surface of the crown part, and the non-metal cover is arranged in the step part.

7. The golf club head according to claim 6, wherein the upper surface of the non-metal cover is flush with the upper surface of the crown part.

8. The golf club head according to claim 1, wherein seeing the golf club head from its plan view, the penetration hole is in an approximately trapezoid shape, of which a longer edge is close to a face side and a shorter edge is close to a back side of the golf club head.

9. The golf club head according to claim 1, wherein the non-metal cover further includes a projection part on a lower surface thereof, the projection part projecting toward the hollow part and fitting in the penetration hole so that the penetration hole is closed.

10. The golf club head according to claim 3, wherein the non-metal cover further includes a projection part projecting and fitting in the penetration hole, and the projection part is arranged at an opposing side from the recess part with respect to the non-metal cover.

11. The golf club head according to claim 1, wherein Shore D hardness of the non-metal cover is ranged within 55 and 80 (inclusive).

12. The golf club head according to claim 1, wherein a width of the recess part, which is determined in a face-back direction, is ranged within 1 mm and 10 mm (inclusive), and a depth of the recess part, which is determined in a crown-sole direction, is ranged within 0.1 mm and 9 mm (inclusive).

13. The golf club head according to claim 1, wherein a width of the penetration hole in a face-back direction is ranged within 2 mm and 30 mm (inclusive).

14. The golf club head according to claim 6, wherein a width of the step part, which is determined in a face-back direction, is ranged within 4 mm and 40 mm (inclusive).

* * * * *